US005358573A

United States Patent [19]

Sivacoe

[11] Patent Number: 5,358,573

[45] Date of Patent: Oct. 25, 1994

[54] METHOD OF CLEANING A PIPE WITH A CYLINDRICAL PIPE PIG HAVING PINS IN THE CENTRAL PORTION

[76] Inventor: Orlande Sivacoe, #601, 4700-55 Street, Red Deer, Alberta, Canada, T4N 2H8

[21] Appl. No.: 61,151

[22] Filed: May 12, 1993

Related U.S. Application Data

[63] Continuation-in-part of Ser. No. 828,234, Jan. 30, 1992, Pat. No. 5,265,302, which is a continuation-in-part of Ser. No. 674,386, Mar. 25, 1991, Pat. No. 5,150,493.

[51] Int. Cl.[5] ..... B08B 9/04

[52] U.S. Cl. ..... 134/8; 134/22.11; 15/104.061

[58] Field of Search ..... 134/8, 22, 11, 22.12; 15/104.061

[56] References Cited

U.S. PATENT DOCUMENTS

| | | | |
|---|---|---|---|
| 2,953,800 | 9/1960 | Bowerman | 15/104.06 |
| 3,474,479 | 10/1969 | Girard | 15/104.06 |
| 3,530,523 | 9/1970 | Ver Nooy | 15/104.06 |
| 3,543,323 | 12/1970 | Girard | 15/104.06 |
| 3,602,934 | 9/1971 | Reed | 15/104.06 |
| 3,857,132 | 12/1974 | Knapp et al. | 15/104.06 |
| 3,879,790 | 4/1975 | Girard | 15/104.06 |
| 3,939,519 | 2/1976 | Muirhead | 15/104.06 |
| 4,016,620 | 4/1977 | Powers | 15/104.06 |
| 4,069,535 | 7/1978 | Cato | 15/104.06 |
| 4,077,079 | 3/1978 | Knapp | 15/104.06 |
| 4,081,875 | 4/1978 | Nishino | 15/104.06 |
| 4,242,771 | 1/1981 | Knapp | 15/104.06 |
| 4,244,073 | 1/1981 | Sagawa | 15/104.061 |
| 4,406,031 | 9/1983 | Eimer et al. | 15/104.06 |
| 4,693,305 | 9/1987 | Fujimoto et al. | 134/8 X |
| 4,825,498 | 8/1989 | Rankin | 15/104.06 |
| 4,876,761 | 10/1989 | Sagawa | 15/104.06 |
| 5,035,021 | 7/1991 | Le Devehat | 15/104.06 |
| 5,157,803 | 10/1992 | Sagawa | 134/8 X |

FOREIGN PATENT DOCUMENTS

| | | | |
|---|---|---|---|
| 5779090 | 6/1990 | Australia . | |
| 0243072 | 9/1987 | European Pat. Off. . | |
| 673740 | 6/1952 | United Kingdom | 134/8 |
| 714105 | 8/1954 | United Kingdom . | |
| 844116 | 8/1959 | United Kingdom . | |
| 2229247 | 9/1990 | United Kingdom . | |

*Primary Examiner*—Richard O. Dean
*Assistant Examiner*—Saeed T. Chaudhry
*Attorney, Agent, or Firm*—Frank J. Dykas; Craig M. Korfanta

[57] ABSTRACT

A pipe pig is reciprocated through a section of a pipe having deposits of scale. In the case of very hard deposits, each pass through the contaminated sections removes a thin layer each time. The location of the coated section can be located by first running the pig through the pipe. The hydraulic pressure is monitored using pen recorders. At each bend in the pipe, a sharp pressure increase will be recorded. The location of the bends can be determined from a drawing of the pipe installation. When the pig encounters scale, there will be a pressure increase that corresponds to the degree of resistance met by the pig resulting from the scale. Greater pressure means greater scale build up. By running the pig through the pipe, a profile of the scale may be created. The location of the scale can be correlated to the known location of the bends. The scale itself can be flushed out with the hydraulic propellant and analyzed. The pin height and hardness can then be selected for the particular scale encountered. The pig may be run backwards and forwards primarily through the contaminated section. After several passes, the pig can be removed from the pipe, the pins replaced or moved radially outward by placing washers between at least some of the pins and the pig body and the pig returned to the pipe.

3 Claims, 3 Drawing Sheets

METHOD OF CLEANING A PIPE WITH A CYLINDRICAL PIPE PIG HAVING PINS IN THE CENTRAL PORTION

CROSS-REFERENCE TO RELATED APPLICATIONS

This is a continuation-in-part of co-pending application Ser. No. 07/828,234 filed Jan. 30, 1992, U.S. Pat. No. 5,265,302 which is a continuation-in-part of application Ser. No. 07/674,386 filed Mar. 25, 1991, now U.S. Pat. No. 5,150,493, issued Sep. 29, 1992.

FIELD OF THE INVENTION

This invention relates to methods of cleaning pipes.

BACKGROUND AND SUMMARY OF THE INVENTION

Pipes used in pipe lines, chemical plants, power generation plants, mines, steel mills, pulp and paper plants, water filtration, sewage treatment plants and the like often carry contaminants that become deposited on the inside of the pipe. These contaminants are generally known as scale, and can be extremely hard, such as coke, calcium, silica, sulfur, iron sulfides and types of ceramic scale. Build up of the scale can cause a variety of problems from reduced production to rupture of the pipe. It is therefore desirable to remove the scale from the pipe.

Various prior art methods have been used to clean the inside of pipes including using wire brushes, steel shot blasting, high pressure water blasting and chemical cleaning. These methods have drawbacks such as incomplete removal of coke, increased pipe erosion and sagging, fire hazards, environmental concerns, long shut down, high cost and decreased production run lengths.

In U.S. Pat. No. 5,150,493, there is disclosed a pig that may be used to clean a pipe. The pig has removable appendages or pins disposed circumferentially around and extending radially outward from the elastomeric body of the pipeline pig. The pins are adjustable to various heights. The pig is forced through the pipe using hydraulic pressure, and the pins scrape the scale from the pipe. This pig has been found to be very successful in overcoming the problems with prior art methods of cleaning pipes.

In co-pending application Ser. No. 07/828,234, a method of use of the pig is described in which the pig is driven backwards and forwards through the section of the pipe that is contaminated with scale. In the case of very hard deposits, each pass through the contaminated sections removes a thin layer of scale. The method described there is expanded upon in this disclosure.

The location of coated sections can be identified by first running the pig through the pipe. The hydraulic pressure is monitored using pen recorders. At each bend in the pipe, a sharp pressure increase will be recorded. The location of the bends can be determined from a drawing of the pipe installation. When the pig encounters scale, there will be a pressure increase that corresponds to the degree of resistance met by the pig resulting from the scale. Greater pressure means greater scale build up. By running the pig through the pipe, a profile of the scale may be created. The location of the scale can be correlated to the known location of the bends. The scale itself can be flushed out with the hydraulic propellant and analyzed. The pin height and hardness can then be selected for the particular scale encountered. The pig may be run backwards and forwards primarily through contaminated sections. After several passes, the pig can be removed from the pipe and the pins replaced or moved radially outward by placing washers between at least some of the pins and the pig body.

BRIEF DESCRIPTION OF THE DRAWINGS

There will now be described a preferred embodiment of the invention, with reference to the drawings, by way of illustration, in which like numerals denote like elements and in which.

DETAILED DESCRIPTION OF PREFERRED EMBODIMENT

Figure 1:
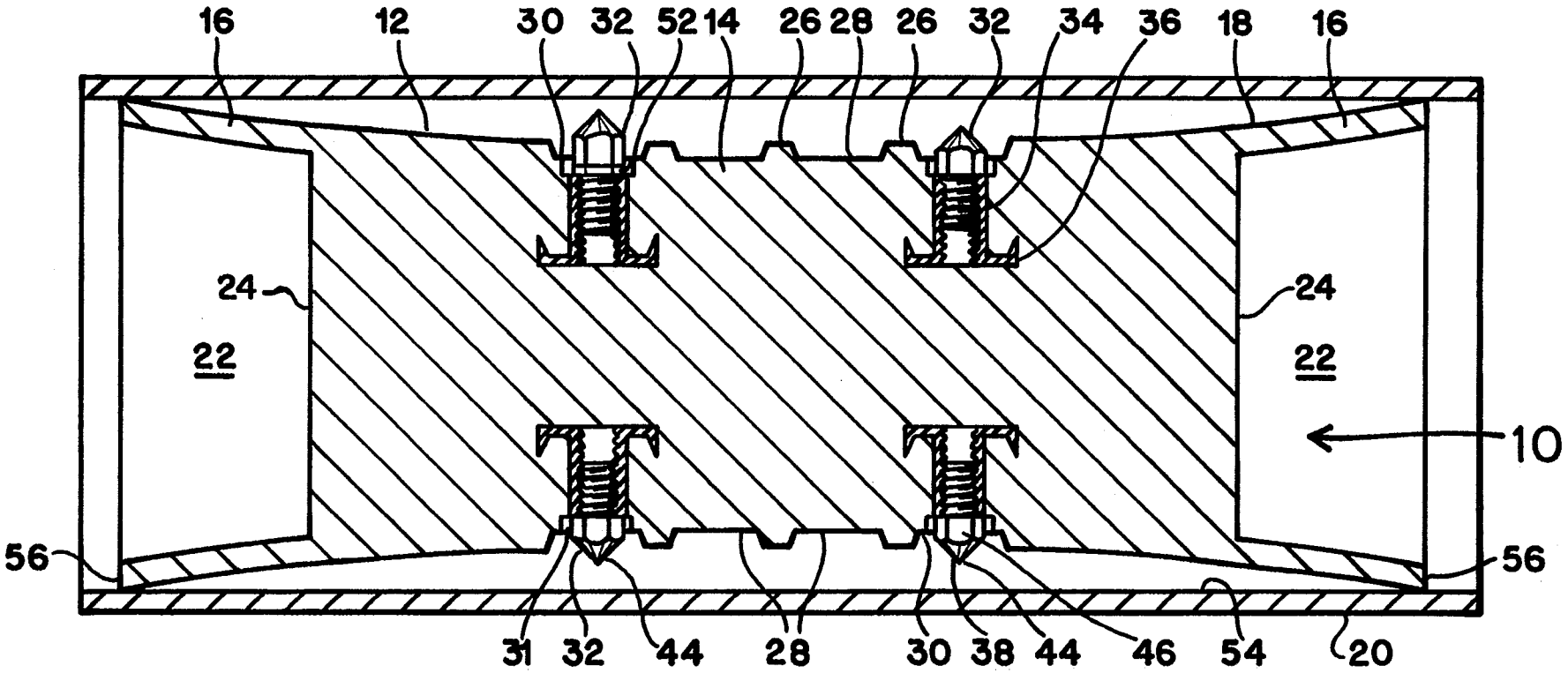
FIG. 1 is a longitudinal section through a pig for use with the method of the invention.

Referring to FIG. 1, there is shown a pig constructed from a generally cylindrical body 10 made of an elastic material, preferably by moulding. The pig is shown in a pipeline 20. The cylindrical body 10 has a first end 12 and second end 18, with central portion 14 of reduced radius. The body includes a plurality of ribs 26, and central annular recessed sections 28 and outer annular recessed sections 30 on either side of the central recessed sections.

Each end 12 and 18 of the body 10 forms a flared and hollow section 16 defining a cavity 22. The radius of the flared ends increases the further away from the central portion of the body to a maximum at the ends 56 of the flared sections 16. The reduction of the radius of the body is preferably greatest at the center of the body (about 0.5 cm at the central rib for a 10 cm pig body) and the cylindrical body has gradually increasing radius with increasing distance from the center of the body.

A plurality of appendages 38 are disposed about and extend radially outward from the cylindrical body 10. Each appendage 38 comprises a head portion 44 and a threaded shank portion 42, preferably integral with each other. The head portion 44 includes a nut shaped portion 46 for engagement by a wrench. Various appendages or pins may be used, having different heights, configurations and hardness, which may be selected depending on the hardness and thickness of the scale encountered. Softer and longer pins may be used for thick, soft scale. Harder and shorter pins may be used for hard scale. The pin selection should be carefully made to prevent undesirable scratching of the inside of the pipe.

Each appendage 38 is secured in the body 10 by being threaded into a first end of a threaded sleeve 34 that is itself secured to the body 10. The nut portion 46 allows the appendage to be readily grasped, rotated and removed from the threaded sleeve 34. The sleeves 34 have laterally extending flanges 36 at their bases, the flanges 36 also preferably including radially extending points 37. The flanges 36 and points 37 secure the sleeves 34 in the body and help prevent the sleeves from being removed from the body, and from being forced deeper into the body. Each appendage 38 with sleeve 34 is secured in one of the recesses 28 or 30 thus forming a plurality of rows of appendages, each row being disposed in a recess. The sleeve is sunk into the body 10 to create a depression 31 about each appendage. The depressions 31 allow the addition of washers 52 to extend the appendages radially outward as they wear.

Figure 2:
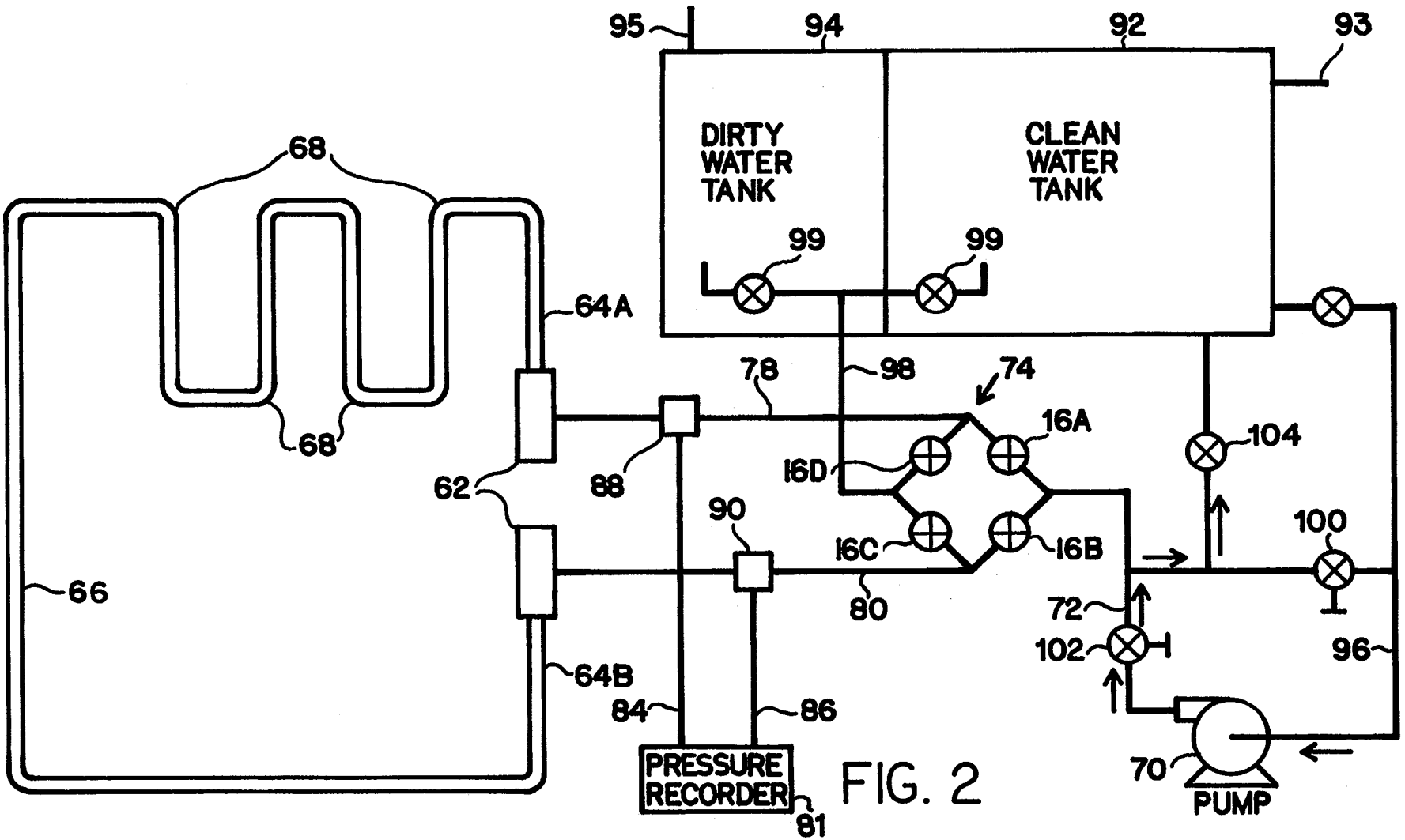
FIG. 2 is a schematic of a pipe installation with pigging equipment for carrying out the method of the invention.
Figure 3:
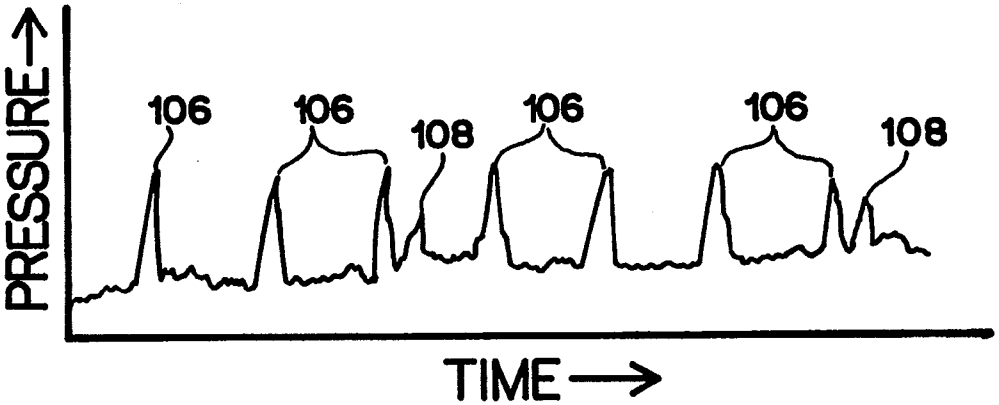
FIG. 3 is a sketch showing a pressure recording.

The manner of operation of the pig is illustrated in FIGS. 2 and 3. The pig is placed in a pig launcher 62, of conventional construction or as described in my copending application Ser. No. 07/980,227 filed Nov. 23, 1992, at one end 64*a* of a pipe 66 having numerous bends 68. The pipe 66 forms a closed loop, with the other end 64*b* also including a pig launcher 62. The launchers 62 may function as launchers and receivers. Since the pig is made from an elastic material, it may pass around bends of 180° with a small radius, although the only bends shown are 90° . A pump 70 supplies hydraulic pressure to both of the pig launchers 62 though line 72 leading to direction manifold 74 formed of four valves 76*a*, 76*b*, 76*c* and 76*d* and onto lines 78 and 80. A pen pressure recorder 82 is attached via lines 84 and 86 to pressure sensors 88 and 90 on lines 78 and 80 respectively. Clean water is obtained from tank 92 through line 96, and dirty water is returned to tank 94 through line 98. Valves 99 on the return line 98 may be used to control the return flow. An intake for the tank 92 is indicated at 93, and an outlet for the tank 94 is indicated at 95. By control of the valves 76 in known manner (close 76*b* and 76*d*, open 76*a* and 76*c*), fluid may be directed through line 78 around the pipe 66, and back through line 80 and the manifold 74 to the dirty water tank 94. The fluid flow in pipe 66 may also be reversed by closing valves 76*a* and 76*c* and closing 76*b* and 76*d*. Globe valves 100 and 102 may be used to regulate flow rate. Valve 104 may be used as a pressure dump for the manifold.

The pen recorder 82 is used for recording the pressure driving the pig. An exemplary recording is shown in FIG. 3. The first run of the pig is used to establish the location of the scale. A pig without pins may be used for this purpose. The pig is first driven through the pipe a first time while recording the hydraulic pressure used to drive the pig. As shown in FIG. 3, peaks 106 on the recorded pressure chart indicate tight bends in the pipe. Lower peaks 108 indicate scale build up. The higher the peak 108, the greater the build up of scale. Visual inspection of the pressure recording can be used to identify sections of the pipe that are contaminated with scale. The type of scale can be determined since the hydraulic fluid will typically bring some of the scale with it, if not during a first run then through a subsequent run. Pins are then selected and inserted into the pig that are selected for the type, hence hardness, and thickness of the scale that is anticipated. The pig is then driven through the pipeline, backwards and forwards, primarily through the sections that are contaminated with scale. Each time the pig is run through a part of the pipeline is called a pass. It may require several hundred passes to clear the coating in a bad section of the pipeline. The pig may be run through 1000 meters of pipeline, while the coated section may only be 200 meters long.

When a coated section is encountered, the outer rows of appendages in the recesses 30 will engage the coating, compress further and begin scraping the coating. The appendages will be compressed by the coating in the pipeline, thus placing pressure on the coating, and the appendages will tend to tilt rearward.

As the outer rows of appendages engage the coating, hydraulic pressure builds up on the end faces 24 of the cylindrical body 10 and compresses the body and expands the central portion 14. The radial expansion of the central portion 14 forces the row of appendages 38 in the inner recesses 28 outward, where they may also engage and compress against the unwanted coating on the inner surface of the pipeline and scrape a portion of the coating off. After numerous passes through the coated section of the pipeline, the appendages will wear and may be replaced with longer appendages or washers (such as washer 52) may be placed between the nut sections 46 of the appendages 38 and the sleeves 34 to move the pins radially outward. The pig may be then run through the contaminated section of the pipeline again, scraping further layers of the coating off. With repeated passes of the pig through the coated section, with succeeding passes using appendages extending further radially outward, successive fine layers of the coating may be removed until the pipeline is substantially free of coating.

After a number of passes the appendages 38 will become excessively worn and will need replacing. By reducing the diameter of the central section of the body of the pig, the appendages in the inner recesses 28 will be less worn and will last longer. The appendages may also be rotated between rows as different appendages become worn. The inside of the pipeline will also be less worn.

The flared ends 16 of the pig shown in FIG. 1 are most useful in situations when it is desirable to prevent by-pass of fluids around the pig. This might occur when it is desirable to know the exact location of the pig, since the amount of fluid being pumped may also then be used to determine the location of the pig accurately. For some applications, such as when there is a large amount of scale in the pipeline, it may be desirable to eliminate the flared ends and allow larger amounts of by-pass using a pig with tapered ends and longer appendages. This will result in a larger clearance between the body 10 and the interior surface of the pipeline. Fluid, usually water, being used to propel the pig, will then by-pass the pig and carry the soft coating in a slurry along and out of the pipeline.

A person skilled in the art could make immaterial modifications to the invention described and claimed in this patent without departing from the essence of the invention.

The embodiments of the invention in which an exclusive property of privilege is claimed are defined as follows:

1. A method of cleaning a pipe contaminated with a scale using a cylindrical pipe pig operated with hydraulic pressure, the pipe pig having a central portion, the method comprising the steps of:

driving the pig through the pipe a first time without pins on the pig while recording the hydraulic pressure to drive the pig;

identifying a section of the pipe that is contaminated with scale by observing and recording locations at which the hydraulic pressure required to drive the pig increases;

identifying the thickness of scale according to the degree of hydraulic pressure required to drive the pig;

sampling the hydraulic fluid to identify the scale in the pipe;

selecting and inserting pins into the central portion of the pig that are selected according to the type and thickness of scale; and moving the pig backwards and forwards primarily through the section of the pipe that is contaminated with scale until a desired amount of scale is removed.

2. The method of claim 1 in which the pipe pig has removable pins and further including the step of:

after moving the pig backwards and forwards primarily through the section of the pipe that is contaminated with scale until a desired amount of scale is removed, removing the pig from the pipe, replacing the removable pins with other pins and driving the pig through the contaminated section again.

3. The method of claim 1 in which the pipe pig has removable pins initially secured in the pig body and further including the step of:

after moving the pig backwards and forwards primarily through the section of the pipe that is contaminated with scale until a desired amount of scale is removed, removing the pig from the pipe, removing at least some of the pins, the pins having shanks, from the pig;

sliding an annular washer over the shank of each pin removed from the pig;

inserting the pins back into the pig, whereby the washer is inserted between at least some of the pins and the pig body; and driving the pig through contaminated section again.

* * * * *